US009797048B2

(12) United States Patent
Lawless

(10) Patent No.: US 9,797,048 B2
(45) Date of Patent: Oct. 24, 2017

(54) STRIPPING SOLUTION FOR ZINC/NICKEL ALLOY PLATING FROM METAL SUBSTRATE

(71) Applicant: THE BOEING COMPANY, Huntington Beach, CA (US)

(72) Inventor: Lawrence M Lawless, Chesterfield, MO (US)

(73) Assignee: THE BOEING COMPANY, Chicago, IL (US)

( * ) Notice: Subject to any disclaimer, the term of this patent is extended or adjusted under 35 U.S.C. 154(b) by 423 days.

(21) Appl. No.: 14/674,570

(22) Filed: Mar. 31, 2015

(65) Prior Publication Data

US 2016/0289614 A1 Oct. 6, 2016

(51) Int. Cl.

| | |
|---|---|
| ***C23F 1/40*** | (2006.01) |
| ***C23F 1/32*** | (2006.01) |
| ***C23F 1/34*** | (2006.01) |
| ***C23F 1/36*** | (2006.01) |
| ***C23F 1/44*** | (2006.01) |
| ***C23G 1/14*** | (2006.01) |
| ***C23G 1/19*** | (2006.01) |

(52) U.S. Cl.

CPC . *C23F 1/40* (2013.01); *C23F 1/44* (2013.01)

(58) Field of Classification Search

CPC ..... C23F 1/32; C23F 1/34; C23F 1/36; C23F 1/40; C23F 1/44; C23G 1/14; C23G 1/19

USPC ..... 106/1.22; 216/100, 105; 132/2

See application file for complete search history.

(56) References Cited

U.S. PATENT DOCUMENTS

| | | | | |
|---|---|---|---|---|
| 3,203,787 | A * | 8/1965 | Grunwald | C23F 1/40 134/2 |
| 3,615,825 | A | 10/1971 | Gansser | |
| 4,111,767 | A * | 9/1978 | Kawagishi | C25F 5/00 205/717 |
| 4,533,639 | A | 8/1985 | Kojima et al. | |
| 4,647,352 | A * | 3/1987 | Cook | C23F 1/40 205/720 |
| 4,720,332 | A * | 1/1988 | Coffey | C23F 1/40 205/720 |
| 5,127,958 | A * | 7/1992 | Personette | C23F 1/40 134/2 |
| 5,279,771 | A * | 1/1994 | Lee | B24B 37/042 134/38 |
| 6,878,215 | B1 * | 4/2005 | Zimmerman, Jr. | C23G 1/20 134/2 |
| 2002/0155048 | A1 * | 10/2002 | Humphreys | C23F 1/44 423/138 |
| 2003/0144164 | A1 * | 7/2003 | Pilznienski | C09D 9/04 134/2 |

(Continued)

FOREIGN PATENT DOCUMENTS

| | | | |
|---|---|---|---|
| GB | 1278954 | A * | 6/1972 |
| SU | 1285061 | A1 * | 1/1987 |

OTHER PUBLICATIONS

English translation fo SU 1285061, Jan. 1987; 6 pages.*

(Continued)

*Primary Examiner* — Helene Klemanski

(74) *Attorney, Agent, or Firm* — Coats & Bennett, PLLC

(57) ABSTRACT

The present disclosure relates generally to the field of electroplating and electroless plating. More specifically, the present disclosure relates to plating solutions and plating removal/stripping solutions for stripping zinc/nickel alloy plating from substrates.

18 Claims, 2 Drawing Sheets

(56) References Cited

U.S. PATENT DOCUMENTS

| | | | | |
|---|---|---|---|---|
| 2013/0276284 | A1* | 10/2013 | Brosseau | C23F 1/44 29/426.1 |
| 2014/0121138 | A1* | 5/2014 | Vollmer | E21B 21/068 507/269 |
| 2015/0048053 | A1* | 2/2015 | Cordonier | C23F 1/40 216/100 |
| 2016/0118264 | A1* | 4/2016 | Kamimura | C23F 1/40 438/703 |
| 2017/0001716 | A1* | 1/2017 | Mierzejewski | C25D 5/36 |

OTHER PUBLICATIONS

S.Spring, Title: Industrial cleaning ; 1974; Chapter VI, pp. 83, 88-89, and 90-91; Publisher-Prism Press; published in New York City, US Dec. 31, 1974.

* cited by examiner

STRIPPING SOLUTION FOR ZINC/NICKEL ALLOY PLATING FROM METAL SUBSTRATE

TECHNOLOGICAL FIELD

The present disclosure relates generally to the field of zinc/nickel plating on metal substrates. More specifically, the present disclosure relates to methods for improving the removal of zinc/nickel plating from metal substrates, including the removal of zinc/nickel plating from steel substrates.

BACKGROUND

In the electrochemical plating field, it is often desirable to strip plating from plated metals. However, many of the known stripping agents are costly and/or difficult to control. In addition, many known stripping agents are hazardous.

For example, the use of cadmium plating for steel parts has long been known. However, the recent categorization of cadmium as a carcinogen has led industry to seek an alternative plating for cadmium. Zinc/nickel alloy plating has been seen as a useful alternative to cadmium plating. Unfortunately, processes using zinc/nickel alloy plating have had their potential utility as a cadmium replacement impacted by the lack of a reliable and convenient stripping solution for the removal of the zinc/nickel alloy plating from substrates, including steel substrates.

Known cadmium plating stripping agents (from steel substrates) typically undergo a chemical reaction that imparts atomic hydrogen to the steel substrate. This is due to the use of ammonium nitrate (which generates hydrogen) in cadmium stripping solutions. The hydrogen-rich environment is not desirable for plated steel being "stripped" of its plating, causing hydrogen-based embrittlement of the steel base metal substrate. Such embrittlement makes the stripped steel unusable for many structurally dependent end uses, and further complicates steel processing, as the embrittled steel must undergo remedial processes such as, for example, baking to become useful for contemplated end uses.

The use of acid-type stripping agents in plating (and stripping) processes also imparts hydrogen to the stripping environment (stripping tanks), resulting in the same above-discussed embrittlement issues relative to the underlying steel base metal. In addition, acid-type stripping agents will further undesirably attack steel substrates.

A useful and effective solution that would act to remove or "strip" plating such as, for example, zinc/nickel alloy plating from metal substrate surfaces, without embrittling or attacking the metal substrate, and would allow for the reuse of the substrate, and eliminate the need for processes to remediate the metal substrates (e.g. baking procedures), would otherwise be highly advantageous.

BRIEF SUMMARY

The present disclosure relates methods and systems for removing zinc/nickel alloy plating from metal substrates, particularly steel substrates. The disclosure also relates to stripping solutions comprising a basic compound, particularly mixtures of a base, such as, for example, sodium hydroxide (NaOH), potassium hydroxide (KOH), etc., and an amine, such as, for example, triethanolamine ($C_6H_{15}NO_3$, or "TEA"), N-aminoethylethanolamine, ethylenediamine, diethylenetriamine, triethylenetetramine, tetraethylenepentamine, pentathylenehexamine, and combinations thereof, and methods and systems for replenishing zinc/nickel plating solutions, as well as plated components using such replenished plating solutions.

Accordingly, one aspect of the present disclosure relates to a method for removing zinc/nickel alloy plating from a substrate. The method comprises immersing a plated substrate into a solution comprising a basic compound and an amine, for a predetermined period of time, with the plated substrate comprising a zinc/nickel alloy plating, and removing the zinc/nickel plating from the substrate.

According to a further aspect, either before, after, or concurrently with the step of removing the zinc/nickel plating from the substrate, removing debris that is attached to the substrate is removed from the substrate by rinsing, wiping, applying ultrasound, applying agitation or combinations thereof.

In a further aspect, the solution is maintained at a temperature of from about 60° F. to about 200° F. In a further aspect, the solution is maintained at room temperature.

In a still further aspect, the basic compound comprises sodium hydroxide, potassium hydroxide, and combinations thereof.

In a still further aspect, the basic compound is maintained in the solution at a concentration of from about 10% to about 35% by weight.

In another aspect, the amine comprises triethanolamine (TEA), triethanolamine ($C_6H_{15}NO_3$, or "TEA"), N-aminoethylethanolamine, ethylenediamine, diethylenetriamine, triethylenetetramine, tetraethylenepentamine, pentathylenehexamine, and combinations thereof.

In yet another aspect, the amine is maintained in the solution at a concentration of from about 1% to about 25% by weight.

In a further aspect, the solution is maintained at a pH of greater than about 11. In another aspect, the solution is maintained at a pH of from about 11 to about 14. In another aspect, the solution is replenished with the basic compound/amine combination whenever a decrease in stripping rate is observed.

According to a further aspect, the substrate comprises steel, stainless steel, aluminum, aluminum alloy, titanium, titanium alloy, copper, copper alloy, and combinations thereof. According to further aspects, processes of the present disclosure may be applied to stripping zinc/nickel alloy plating that also comprises chromates.

In another aspect, the present disclosure relates to a solution for removing zinc/nickel alloy plating from a substrate, with the solution comprising a basic compound in an amount of from about 10% to 35% by weight, and an amine in an amount of from about 1% to about 25% by weight.

In a further aspect, the solution is maintained at a pH greater than about 11. In another aspect, the solution is maintained at a pH of from about 11 to about 14. In another aspect, the solution is replenished with the basic compound/amine combination whenever a decrease in stripping rate is observed.

In yet another aspect, the solution comprises sodium hydroxide, potassium hydroxide, and combinations thereof, etc.

In a further aspect, the amine comprises triethanolamine (TEA), N-aminoethylethanolamine, ethylenediamine, diethylenetriamine, triethylenetetramine, tetraethylenepentamine, pentathylenehexamine, and combinations thereof.

In yet another aspect, the substrate comprises steel, stainless steel, aluminum, aluminum alloy, titanium, titanium alloy, copper, copper alloy, and combinations thereof.

In another aspect, the present disclosure relates to a method for replenishing a zinc/nickel alloy plating solution comprising zinc ions and nickel ions comprising immersing a plated substrate into a solution comprising a basic compound and an amine for a predetermined time, with the plated substrate comprising a zinc/nickel alloy plating, and removing zinc ions and nickel ions from the plated substrate.

In another aspect, the solution is maintained at a temperature of from about 60° F. to about 200° F. In a further aspect, the solution is maintained at room temperature.

In a still further aspect, the basic compound comprises sodium hydroxide, potassium hydroxide, and combinations thereof, at a concentration of from about 10% to about 35% by weight.

In yet another aspect, the amine comprises triethanolamine (TEA), N-aminoethylethanolamine, ethylenediamine, diethylenetriamine, triethylenetetramine, tetraethylenepentamine, pentathylenehexamine, and combinations thereof.

According to a further aspect, the substrate comprises steel, stainless steel, aluminum, aluminum alloy, titanium, titanium alloy, copper, copper alloy, and combinations thereof.

According to another aspect, the replenishing method comprises immersing a plated substrate into a plating solution comprising a basic compound alone, or in the presence of an amine for a predetermined time with no electrical current applied, with the plated substrate comprising a zinc/nickel alloy plating, and removing zinc ions and nickel ions from the substrate, with the zinc ions and nickel ions that are removed from the substrate used to replenish the plating solution. In this aspect, a zinc/nickel plating solution is actually being used as a zinc/nickel stripping solution (with no electrical current applied) and stripped zinc ions and nickel ions from the stripped zinc/nickel plating replenishes the zinc/nickel plating solution, saving the expense of conventional replenishing of expensive metal ions to the plating solution. In other words, through the use of the same zinc/nickel plating solution "off cycle" as a zinc/nickel stripping solution, the expensive zinc and metal ions are "recycled" or "reclaimed" into the zinc/nickel plating solution from the zinc/nickel plating stripped from a zinc/nickel-plated substrate.

In another aspect, the present disclosure relates to a plating solution for plating zinc/nickel-containing alloy onto a substrate, with the plating solution comprising an amount of basic compound in an amount of from about 10% to about 35% by weight, wherein an amount of zinc ions and nickel ions are replenished to the plating solution by immersing a substrate plated with a zinc/nickel alloy, stripping zinc ions and nickel ions from the substrate, and returning the zinc ions and nickel ions to the plating solution.

In yet another aspect, the present disclosure relates to a plating solution for plating zinc/nickel-containing alloy onto a substrate, with the plating solution comprising an amount of basic compound in an amount of from about 10% to about 35% by weight, and an amine in an amount of from about 1% to about 25% by weight, wherein an amount of zinc ions and nickel ions are replenished to the plating solution by immersing a substrate plated with a zinc/nickel alloy, stripping zinc ions and nickel ions from the substrate, and returning the zinc ions and nickel ions to the plating solution.

In yet another aspect, the basic compound comprises sodium hydroxide, potassium hydroxide and combinations thereof.

In still another aspect, the amine comprises triethanolamine (TEA), N-aminoethylethanolamine, ethylenediamine, diethylenetriamine, triethylenetetramine, tetraethylenepentamine, pentathylenehexamine, and combinations thereof.

In still another aspect, the substrate comprises steel, aluminum, aluminum alloy, titanium, titanium alloy, copper, copper alloy, stainless steel, and combinations thereof.

In another aspect, a component comprises a zinc/nickel alloy plated substrate.

In a further aspect, an object comprises the component comprising the zinc/nickel alloy plated substrate.

In yet another aspect, an object comprising the component comprising the zinc/nickel alloy substrate is, for example, an aircraft, a vehicle, and a stationary object.

BRIEF DESCRIPTION OF THE DRAWINGS

Figure 1:
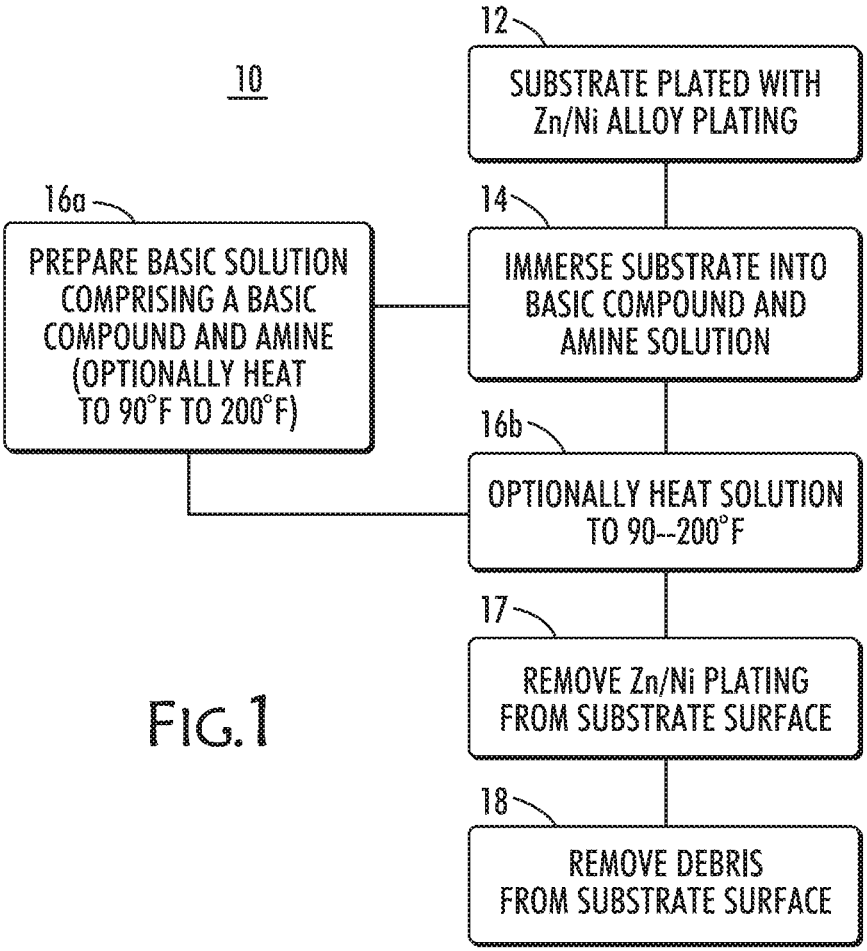

Having thus described variations of the disclosure in general terms, reference will now be made to the accompanying drawings, which are not necessarily drawn to scale, and wherein:

FIG. 1 is a flow chart showing an aspect of the present disclosure; and

Figure 2:
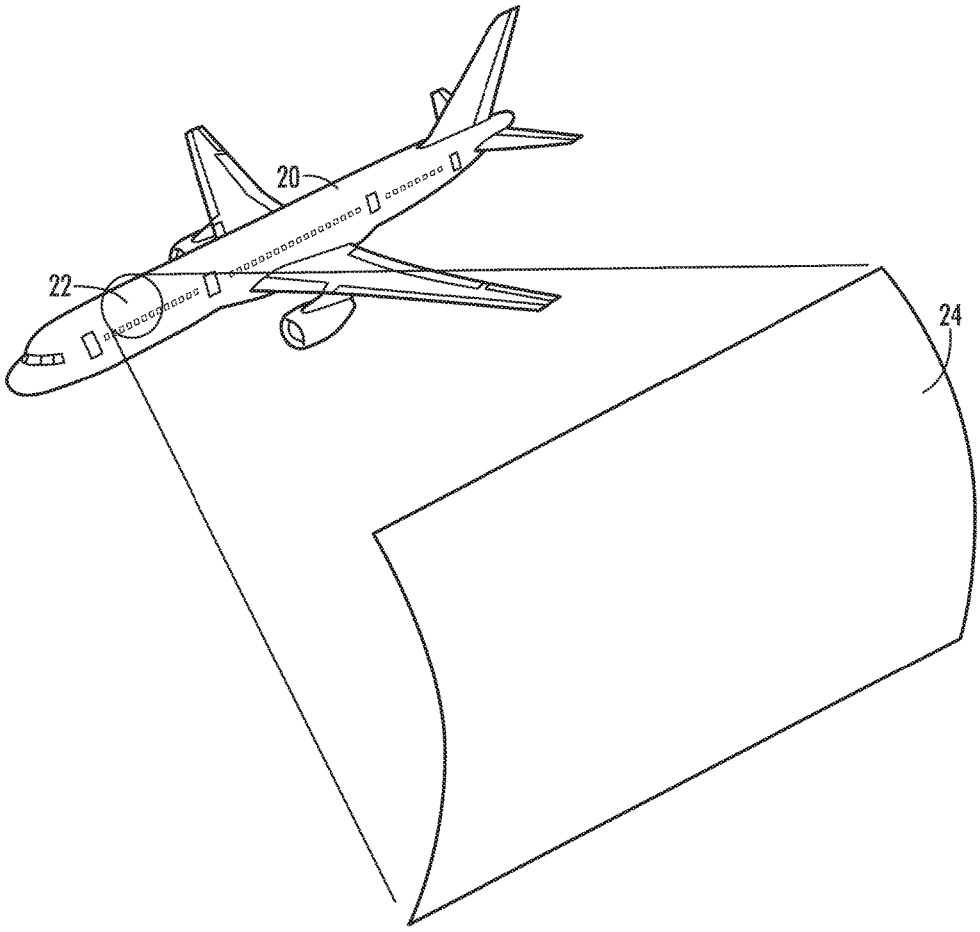

FIG. 2 is drawing of an aircraft comprising parts plated using reclaimed zinc and nickel according to aspects of the present disclosure.

DETAILED DESCRIPTION

Known stripping solutions that remove Zn/Ni alloy plating from substrates often comprise ammonium nitrate that generate hydrogen that can undesirably embrittle the substrate, resulting in the need to remediate the substrate by further processing the stripped substrate (e.g. baking processes) before the substrate can be re-used.

According to an aspect of the present disclosure, a basic compound-containing stripping solution that is highly basic, along with the addition of an amine, has now been shown to efficiently, reliably and cost-effectively strip zinc/nickel plating from metal substrates, without imparting any embrittlement to the metal substrate. According to one aspect, the basic compound comprises a compound such as, for example, sodium hydroxide, potassium hydroxide and combinations thereof in an amount of from about 10 to about 35% by weight. In a further aspect, the amine comprises, for example, triethanolamine (TEA), N-aminoethylethanolamine, ethylenediamine, diethylenetriamine, triethylenetetramine, tetraethylenepentamine, pentathylenehexamine, and combinations thereof in an amount of from about 1 to about 25% by weight. According to one embodiment, sodium hydroxide is provided to a solution along with TEA. By using a non-acidic stripping solution (and thus preventing the generation of hydrogen to the stripping solution system), hydrogen embrittlement and other attack of a metal substrate, such as, for example, steel, is significantly minimized, and/or substantially eliminated. While a solution having a basicity (basic pH) of greater than at least about 11 (and in one aspect a solution with a pH from about 11 to about 14) has now been shown to work as a zinc/nickel stripping solution, it now also has been demonstrated that, as the solution basicity increases, and an amine such as, for example, N-aminoethylethanolamine, ethylenediamine, diethylenetriamine, triethylenetetramine, tetraethylenepentamine, pentathylenehexamine, and combinations thereof, is introduced to the stripping solution, the stripping time decreases significantly (and the stripping rate increases significantly). Without being bound by any particular theory, it is believed to be advantageous to maintain the pH as high as possible, (e.g., greater than about 11), without thickening the solution to the point of an unusable viscosity.

FIG. 1 is a flow chart showing one aspect of the present disclosure. According to process 10, a substrate that has been plated with a Zn/Ni alloy plating 12 is subjected to a step of immersing the substrate 12 into a solution comprising a basic compound and an amine maintained at a pH of from about 11 to about 14, 14. Optionally, the solution comprising a basic compound and an amine 14 may be subjected to a one of two heating steps; 1) the solution comprising a basic compound and an amine is heated to a temperature above room temperature before the substrate is immersed in the solution 16*a*; or 2) the solution comprising a basic compound and an amine is heated to a temperature above room temperature after the substrate is immersed in the solution 16*b*. Room temperature is understood to be an ambient temperature of from about 65° F. to about 85° F. The substrate is then left immersed in the solution comprising a basic compound and an amine for a predetermined amount of time (not shown) and Zn/Ni alloy plating is removed from the substrate surface 17. It is understood by those skilled in the field that the stripping time will depend upon the thickness of the Zi/Ni alloy plating being stripped. Concurrently with, or subsequent to, the removal of the Zn/Ni alloy plating being stripped from the substrate, "smut" or other debris is often formed on the substrate surface. As a result, the stripped substrate is then subjected to a step to remove debris from the substrate surface 18.

EXAMPLES

Experiments were conducted to determine the effectiveness of a stripping solution comprising sodium hydroxide/triethanolamine to remove zinc/nickel alloy plating from steel substrate test specimens plated with a zinc/nickel alloy. Test specimen steel substrates were 4130 steel cut into 1"×4" rectangles, having a thickness of about 0.04". The test specimens were plated with approximately 1 mil (0.001") zinc/nickel alloy. The test specimens were then immersed in various stripping solutions. The selected stripping solution and the results obtained are shown below in Table 1. Room temperature is understood to be a temperature of from about 65 to 85° F.

TABLE 1

| Solution | Stripping Time | Agitation Y/N | Temperature ° F. |
|---|---|---|---|
| Ammonium Nitrate/$H_2O$ 150 g/l | Approx. 24 hours | N | Room Temp. |
| Ammonium Nitrate/$H_2O$ 240 g/l | 4-5 hours | N | Room Temp. |
| Ammonium Nitrate/$H_2O$ 312 g/l | 20 min. | Y | Room Temp. (pH adjusted to 8.0 with Ammonium Hydroxide |
| Turco Alkaline Rust Remover - MAC 240 g/l | 30 min. | N | 160 |
| Turco Alkaline Rust Remover - MAC 240 g/l | 70 min. | N | Room Temp. |
| Sodium Hydroxide 240 g/l | 70 min. | N | Room Temp. |
| Sodium Hydroxide | 30 min. | N | Room Temp. |

TABLE 1-continued

| Solution | Stripping Time | Agitation Y/N | Temperature ° F. |
|---|---|---|---|
| 20% by weight Sodium Hydroxide/TEA | 15 min. | N | Room Temp. |
| 20%/15% by weight Zn/Ni Plating solution (Dipsol) [Dipsol of America, Livonia, Mich.] | 12 hours | N | Room Temp. |

The systems and methods set forth herein are contemplated for use with producing zinc/nickel alloy plated components for use in manned or unmanned vehicles or objects of any type or in any field of operation, such as in a terrestrial and/or non-terrestrial and/or marine or submarine setting. A non-exhaustive list of contemplated objects include, manned and unmanned aircraft, spacecraft, satellites, terrestrial, non-terrestrial vehicles, and surface and sub-surface water-borne vehicles, etc., as well as stationary objects. FIG. 2 shows an aircraft 20 comprising a fuselage panel 24 from a fuselage section 22. Fuselage section 22 comprises component parts (not shown) that may themselves comprise a substrate material plated with a Zn/Ni alloy plating solution that has been at least partially replenished with zinc and nickel that has been recovered and introduced into the plating tank/bath by immersing a substrate plated with Zn/Ni alloy and then stripping the Zn/Ni alloy plating from the substrate.

When introducing elements of the present disclosure or exemplary aspects or embodiment(s) thereof, the articles "a," "an," "the" and "said" are intended to mean that there are one or more of the elements. The terms "comprising," "including" and "having" are intended to be inclusive and mean that there may be additional elements other than the listed elements. While the preferred variations and alternatives of the present disclosure have been illustrated and described, it will be appreciated that various changes and substitutions can be made therein without departing from the spirit and scope of the disclosure. Although specific aspects have been described, the details of these aspects are not to be construed as limitations.

What is claimed is:

1. A method for removing zinc/nickel alloy plating from a plated substrate comprising the steps of:

immersing a plated substrate into a solution comprising a basic compound and an amine for a predetermined time, said plated substrate comprising a zinc/nickel alloy plating; and removing the zinc/nickel plating from the substrate.

2. The method of claim 1, before, after or concurrently with the step of removing the zinc/nickel plating from the substrate, further comprising the step of:

removing debris attached to the substrate by wiping, applying ultrasound, applying agitation, or combinations thereof.

3. The method of claim 1, wherein the solution is maintained at a temperature of from about 60° F. to about 200° F.

4. The method of claim 1, wherein the basic compound comprises sodium hydroxide, potassium hydroxide and combinations thereof.

5. The method of claim 1, wherein the basic compound is maintained in the solution at a concentration of from about 10% to about 35% by weight.

6. The method of claim 1, wherein the amine comprises triethanolamine, N-aminoethylethanolamine, ethylenediamine, diethylenetriamine, triethylenetetramine, tetraethylenepentamine, pentathylenehexamine, and combinations thereof.

7. The method of claim 1, wherein the amine is maintained in the solution at a concentration of from about 1% to about 25% by weight.

8. The method of claim 1, wherein the solution is maintained at a pH of greater than about 11.

9. The method of claim 1, wherein the plated substrate comprises steel, stainless steel, aluminum, aluminum alloy, titanium, titanium alloy, copper, copper alloy, and combinations thereof.

10. A method for replenishing a zinc/nickel alloy plating solution comprising zinc ions and nickel ions, said method comprising the steps of:

immersing a plated substrate into a solution comprising a basic compound and an amine for a predetermined time, said plated substrate comprising a zinc/nickel alloy plating; and removing zinc ions and nickel ions from the substrate.

11. The method of claim 10, wherein the solution is maintained at a temperature of from about 60° F. to about 200° F.

12. The method of claim 10, wherein the basic compound is maintained in the solution at a concentration of from about 10% to about 35% by weight.

13. The method of claim 10, wherein the amine is maintained in the solution at a concentration of from about 1% to about 25% by weight.

14. The method of claim 10, wherein the basic compound comprises sodium hydroxide, potassium hydroxide and combinations thereof.

15. The method of claim 10, wherein the amine comprises triethanolamine, N-aminoethylethanolamine, ethylenediamine, diethylenetriamine, triethylenetetramine, tetraethylenepentamine, pentathylenehexamine, and combinations thereof.

16. A plating solution for plating zinc/nickel-containing alloy onto a substrate, said plating solution comprising:

an amount of basic compound in an amount of from about 10% to about 35% by weight;

wherein an amount of zinc and nickel ions are replenished to the plating solution by immersing a substrate plated with a zinc/nickel alloy, stripping zinc ions and nickel ions from the substrate, and returning the zinc ions and nickel ions to the plating solution.

17. The plating solution of claim 16 further comprising:

an amount of amine in an amount of from about 1% to about 25% by weight, wherein the amine comprises triethanolamine, N-aminoethylethanolamine, ethylenediamine, diethylenetriamine, triethylenetetramine, tetraethylenepentamine, pentathylenehexamine, and combinations thereof.

18. The plating solution of claim 16, wherein the basic compound comprises sodium hydroxide, potassium hydroxide and combinations thereof.

* * * * *